US005652778A

United States Patent [19]

Tekriwal

[11] Patent Number: 5,652,778

[45] Date of Patent: Jul. 29, 1997

[54] COOLING X-RAY TUBE

[75] Inventor: Prabhat Kumar Tekriwal, Schenectady, N.Y.

[73] Assignee: General Electric Company, Schenectady, N.Y.

[21] Appl. No.: 543,094

[22] Filed: Oct. 13, 1995

[51] Int. Cl.[6] ..... H01J 35/10

[52] U.S. Cl. ..... 378/132; 378/128; 378/144

[58] Field of Search ..... 378/144, 143, 378/132, 125, 127, 128, 131

[56] References Cited

U.S. PATENT DOCUMENTS

| | | | |
|---|---|---|---|
| 3,710,162 | 1/1973 | Bougle | 378/144 X |
| 4,679,220 | 7/1987 | Ono | 378/144 X |
| 4,920,551 | 4/1990 | Takahashi et al. | 378/144 X |
| 5,091,927 | 2/1992 | Golitzer et al. . | |

OTHER PUBLICATIONS

Schreiber, "Heat Management in X-ray Tubes", Medica-Mundi, vol. 35, 1990, pp. 49–56.

General Electric, "The 9800 Tube Unit", commercial product more than one year, four pages.

*Primary Examiner*—David P. Porta

*Attorney, Agent, or Firm*—Marvin Snyder

[57] ABSTRACT

An X-ray tube includes a housing containing an anode target having a target shaft supported in the housing by a bearing. The target is rotated, and a cathode emits an electron beam against the target to create X-rays which are discharged from the tube through a window therein. The target shaft is integral with the target and extends axially therefrom for conducting heat away from the target and to the shaft without joint heat resistance. The bearing includes a rotor hub to which the target shaft is removably joined and is configured for improving heat conduction to a stator of the bearing for preferentially limiting the temperature thereof.

11 Claims, 3 Drawing Sheets

COOLING X-RAY TUBE

BACKGROUND OF THE INVENTION

The present invention relates generally to X-ray tubes, and, more specifically, to improved cooling of the targets therein.

An X-ray tube includes cathode and anode assemblies suitably mounted in an evacuated glass frame or housing. The anode assembly includes a target in the form of a disk which is rotated at high speed adjacent to a cathode which emits an electron beam against a focal track adjacent to a perimeter of the target. A small portion of the electrons are converted at the focal track as an X-ray beam which passes through a window in the housing for use in conventional manners.

In an X-ray tube, less than about 1% of the electrical energy is converted into X-rays, with the remainder of the energy producing waste heat in the target. Accordingly, dissipating the heat from the target is one of the most important functions of the X-ray tube and its housing. The X-ray tube is typically immersed in a cooling fluid such as oil which is channeled over the outside of the tube for removing the heat therefrom during operation. However, the heat generated at the target inside the tube housing must also be suitably dissipated therefrom.

The X-ray tube is typically operated in cycles having one period in which X-rays are generated followed in turn by a cooling period to limit the temperature of the various components of the tube for maintaining an acceptable life. In the first few minutes of the cooling period, cooling of the target is radiation dominated, with radiation heat transfer being proportional to the fourth power of temperature. After the initial radiation cooling period, heat transfer is dominated by conduction from the target and through the remainder of the anode assembly to the tube housing.

Since the target rotates during operation, it is mounted in suitable ball or journal bearings inside the housing which themselves have corresponding temperature limits of operation for ensuring a useful life thereof. The target is typically bolted to a rotor supported by the bearings, with the bolts also having corresponding temperature limits for effective useful life thereof. Accordingly, conduction of heat from the target necessarily heats the target bolts and supporting bearings, with the heating thereof being suitably limited for obtaining a suitable useful life.

The temperature limits of the target bolts and bearings therefore control the X-ray producing period and the cooling period in the operating cycle of the X-ray tube. It is desirable to maximize the X-ray producing period and minimize the cooling period so that the X-ray tube may be operated for longer periods. In a typical application where the X-ray tube is used in a Computer Tomography (CT) scanner, reduced cooling periods will correspondingly increase the number of CT scans in a given time improving the efficiency of operation of the CT scanner.

Although it is generally desirable to increase heat conductivity from the target to the supporting bearings, such conductivity must also be limited in the region of the target mounting bolts to prevent their overheating. A typical target is removably mounted to one end of a target shaft creating a joint thereat, with the target shaft in turn being mounted to the bearing rotor creating another joint thereat. Both joints are simple contact joints which inherently provide resistance to heat conduction thereat which is typically used for limiting the temperature of the attachment bolts at the two joints for effecting a useful life thereof. Accordingly, heat conduction through the joints is reduced, which reduces heat transfer into the bearings and in turn from the tube housing. This controls the respective durations of the X-ray producing and cooling periods of the X-ray tube operating cycle.

SUMMARY OF THE INVENTION

An X-ray tube includes a housing containing an anode target having a target shaft supported in the housing by a bearing. The target is rotated, and a cathode emits an electron beam against the target to create X-rays which are discharged from the tube through a window therein. The target shaft is integral with the target and extends axially therefrom for conducting heat away from the target and to the shaft without joint heat resistance. The bearing includes a rotor hub to which the target shaft is removably joined and is configured for improving heat conduction to a stator of the bearing for preferentially limiting the temperature thereof.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DESCRIPTION OF THE PREFERRED EMBODIMENT(S)

Figure 1:
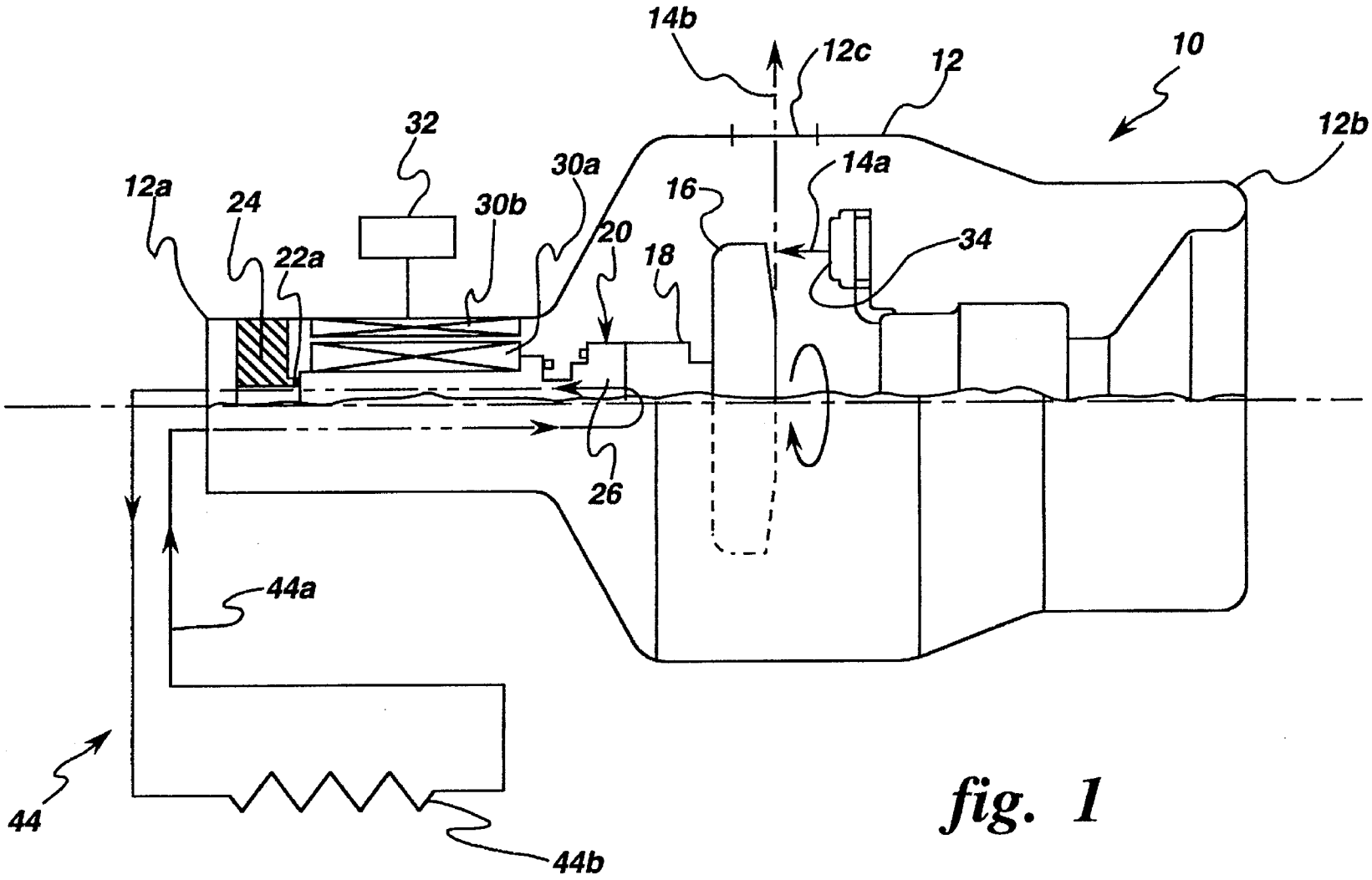
FIG. 1 is a schematic representation, partly in section, of an exemplary X-ray tube having an improved target and target shaft joined to a bearing therein.

Illustrated schematically in FIG. 1 is an exemplary X-ray tube 10 in accordance with one embodiment of the present invention. The tube 10 includes a conventional annular glass frame or housing which is suitably evacuated for maintaining a vacuum therein. The housing 12 includes a proximal end 12*a* and an opposite distal end 12*b*, with a window 12*c* disposed axially therebetween. The tube 10 is generally axisymmetrical about a longitudinal or axial centerline axis and includes anode and cathode assemblies therein for emitting an electron beam 14*a*, a portion of which is converted to an X-ray beam or X-rays 14*b* which are emitted through the window 12*c*.

More specifically, the anode assembly includes an improved, annular anode target 16 in the form of a disk having a target shaft 18 disposed integrally therewith and extending axially away therefrom for being rotatably supported to the housing 12 by a journal bearing 20 which allows rotation of the target 16 about the centerline axis of the tube 10.

Figure 2:
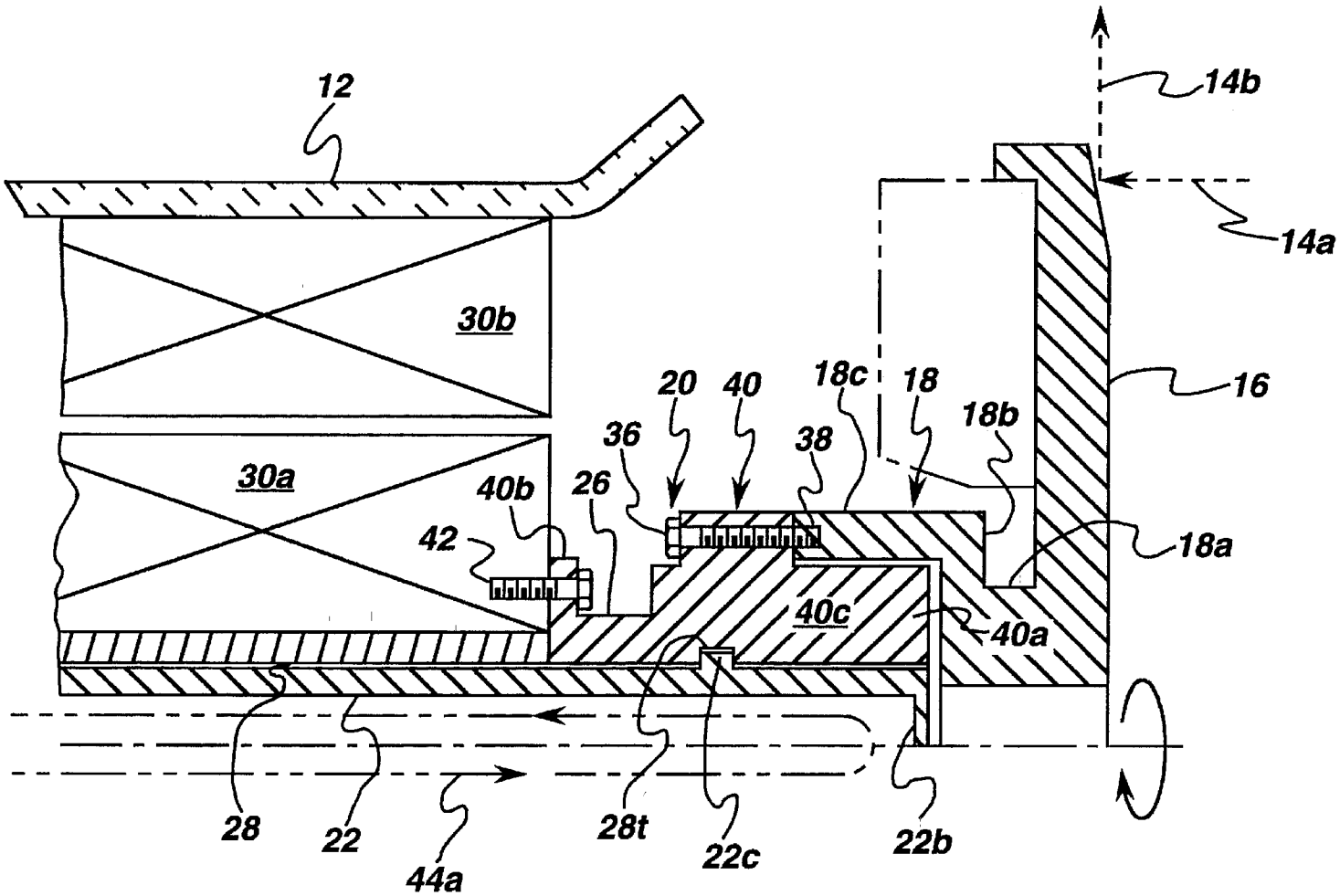
FIG. 2 is a schematic sectional view of an enlarged portion of the target, target shaft, and bearing along an axial centerline axis of the tube illustrated in FIG. 1 in accordance with one embodiment of the present invention.

Referring also to FIG. 2, the bearing 20 includes a tubular bearing stator 22 extending coaxially inside the housing 12, and having a proximal end 22*a* suitably fixedly joined to the housing 12 by a conventional annular support 24. The bearing stator 22 has an opposite distal end 22*b* as shown in FIG. 2. Concentrically surrounding the bearing stator 22 is a tubular bearing rotor 26 which defines radially therebetween a suitable journal annulus 28 which receives a suitable liquid lubricant such as liquid Gallium. The liquid lubricant rotatably supports the bearing rotor 26 on the stator 22 as a conventional journal bearing, and may take any suitable configuration as desired for supporting radial loads generated during rotation of the target 16.

The journal annulus 28 conventionally operates to support radial bearing loads between the bearing rotor 26 and stator 22. Thrust loads on the bearing rotor 26 may be accommodated by any conventional thrust bearing located at any suitable position. In the exemplary embodiment illustrated in FIG. 2, the bearing stator 22 may include an annular radial land 22*c* suitably spaced axially from the stator distal end 22*b* to define a thrust bearing 28*t* with the rotor 26. The thrust bearing 28*t* is disposed in flow communication with the journal annulus 28 and shares the liquid lubricant.

Conventional means are provided for rotating the bearing rotor 26 and in turn the target 16 attached thereto for distributing the electron beam 14*a* uniformly around a focal track near the perimeter of the target 16 to correspondingly spread the heat inputs therein in a conventional manner. The target 16 itself may take any conventional form and may have a conventional backing plate illustrated in phantom in FIG. 2. In the exemplary embodiment illustrated in FIGS. 1 and 2, the back or proximal end of the bearing rotor 26 supports a conventional rotor winding 30*a* cooperating with a concentric conventional stator winding 30*b* suitably mounted to the housing 12, which collectively define an electrical motor suitably powered by a conventional power supply 32.

The cathode assembly illustrated in FIG. 1 is conventional and includes a suitable cathode 34 which is effective for emitting the electron beam 14*a* to impinge the focal track of the target 16 for in turn emitting the X-rays 14*b* through the window 12*c* during operation. The electron beam 14*a* may have any suitable power, and in the exemplary embodiment is suitably configured for producing a heat input into the target 16 of about 4.0 kW steady-state. This relatively high heat input into the target 16 must be suitably managed for maintaining various operating temperatures of the tube 10 below specified limits for ensuring a useful life of the tube 10. The tube 10 is conventionally operated in alternating periods of X-ray production and cooling to ensure that temperatures of the tube 10 are maintained within acceptable limits. The produced X-rays may be used for any conventional purpose, with the X-ray tube 10 being configured specifically for a Computer Tomography (CT) scanner.

Cooling of the target 16 is dominated in the first few minutes of the cooling period by radiation heat transfer which is proportional to the fourth power of temperature. After the initial brief cooling period of the target 16 by radiation, conduction heat transfer dominates the cooling behavior of the target 16. In accordance with the present invention, improved heat management by conduction is effected for reducing the time required for cooling the target 16, and thereby increasing the number of CT scans in a given time. Improved heat conduction management is obtained while maintaining maximum bearing temperature and bolt temperature below corresponding design limits.

More specifically, and referring to FIG. 2, the target 16 is preferably removably joined to the bearing 20 for allowing assembly and disassembly. This therefore requires a suitable fastener such as a plurality of circumferentially spaced apart bolts 36. Heat conduction from the target 16 will necessarily heat the bolts 36 as the heat travels to lower temperatures of the tube 10 such as the bearing stator 22 and rotor 26 and the bearing lubricant found in the journal annulus 28. It is desirable to maximize heat conduction away from the target 16 and into the bearing 20, while at the same time not excessively heating the bolts 36 for maintaining their temperature within a suitable design limit for obtaining a useful life thereof.

In accordance with one feature of the present invention as illustrated in FIG. 2, the target shaft 18 is disposed integrally with the target 16 in a combined one-piece component for eliminating any joint therebetween which would effect resistance or obstruction to heat conduction therethrough. The target shaft 18 extends axially away from the back side of the target 16 toward the proximal end 12*a* of the housing 12 for conducting heat away from the target 16 and through the integral shaft 18 without heat resistance or obstruction due to any joints or similar discontinuities therebetween. The target shaft 18 may be formed integrally with the target 16 in a common casting or forging, or may be suitably welded or brazed thereto. The target shaft 18 is removably joined to the bearing rotor 26 by the bolts 36 at an abutting target joint 38 which creates a preferential heat conduction resistance thereat for limiting heat conduction into the bolts 36 and limiting their temperature rise during operation. Heat conduction, however passes from the target shaft 18 and into the bearing rotor 26 for conducting heat away from the target 16 during operation.

In accordance with the present invention, the bearing rotor 26 includes an annular, bulbous hub 40 disposed at the bearing stator distal end 22*b* with the hub 40 having a larger outer diameter than typically found in conventional X-ray tubes having ball bearing supported targets for allowing more heat conduction initially axially through the hub 40 and then radially inwardly into the lubricant within the journal annulus 28. By selectively configuring the various dimensions of the target shaft 18 and the rotor hub 40 to which it is attached, heat from the target 16 may be preferentially channeled to the lubricant in the journal annulus 28 in a more uniform distribution to more effectively dissipate heat from the target 16 without undesirably concentrating the heat at any particular location resulting in a temperature limited location. For example, target attachment bolts in conventional designs are one known location which limit operation of the X-ray tube since the maximum temperature thereof must be maintained within a specified limit for obtaining a useful life. Since the rotating target 16 must be attached to a suitable bearing, another limiting location is the attachment of the target 16 to the distal end region of the bearing which receives heat from the target 16.

As shown in FIG. 2, the target shaft 18 extends axially away from the target 16 to provide a resulting longer temperature gradient therewith, and is preferably disposed radially above the journal annulus 28 so that heat conduction from the target shaft 18 enters the rotor hub 40 initially axially followed in turn by radially inwardly into the lubricant in the journal annulus 28. The target shaft 18 is preferably hollow in the form of a tube to limit heat conduction directly into the distal end 22*b* of the bearing stator 22. It is undesirable to conduct heat from the target 16 into any one small location of the journal annulus 28, and in particular the distal end thereof, since the temperature thereof will more quickly rise to the specified maximum limit. By spreading the heat conduction from the target 16 through the target shaft 18 into the bearing rotor hub 40, the heat is more uniformly dissipated for reducing the heating time and temperature at the various locations, such as at the distal end 22*b* of the bearing stator 22 which is most closely positioned adjacent to the target 16.

The rotor hub 40 illustrated in FIG. 2 includes a flat front end 40*a* which faces the target 16, an opposite back end 40*b* which is suitably fixedly joined to the rotor winding 30*a* by suitable bolts 42, and a substantially solid middle portion 40*c* extending axially from the front to back ends 40*a* and 40*b*. In accordance with one embodiment of the present invention, the target shaft 18 is joined to a suitable location from the hub front end 40*a* to the hub middle portion 40*c* for first conducting heat from the target 16 axially into the middle portion 40*c* prior to conducting the heat radially inwardly toward the journal annulus 28. In this way, heat conduction to the journal bearing 20 at the distal end 22*b* of the bearing stator 22 may be reduced for correspondingly reducing the heating time thereof and the maximum attained temperature thereof during operation.

In the preferred embodiment illustrated in FIG. 2, the hub front end 40*a* is flat and is spaced axially from a radially inner portion of the target shaft 18 for preventing direct heat conduction therebetween. The hub middle portion 40*c* has a circumference to which the target shaft 18 is joined by the bolts 36. As illustrated in FIG. 2, the outer circumference of the hub middle portion 40*c* has a radial step defining a flange against which the flat annular back end of the target shaft 18 abuts to define therewith the target joint 38. The target joint 38 is generally positioned near the axial middle of the rotor hub 40 between the front and back ends 40*a* and 40*b* thereof to provide a middle attachment point for the target shaft 18.

Correspondingly, the target shaft 18 is formed in the general shape of an elbow in axial section defining a counterbore in which the hub distal end 40*a* is coaxially disposed. The target shaft 18 preferably includes a tubular front or first portion 18*a* extending axially away from the center of the target 16; a middle or second portion 18*b* in the form of a disk extending radially outwardly from the distal end of the first portion 18*a* and spaced axially from both the hub front end 40*a* and the bearing stator distal end 22*b*; and a tubular back or third portion 18*c* extending axially backwardly away from the second portion 18*b* at the circumference thereof. The third portion 18*c* is coaxial and parallel with the first portion 18*a*, with the third portion 18*c* being spaced radially outwardly in part from the hub middle portion 40*c* to prevent radial heat conduction therebetween. In this way, heat conduction from the target shaft 18 is prevented at the bearing stator distal end 22*b*, at the hub front end 40*a*, and for a suitable axial distance along the hub middle portion 40*c*. Heat conduction, from the target 16 is therefore channeled through the serpentine target shaft 18 and enters the hub middle portion 40*c* at the target joint 38 around its outer circumference. The step flange around the circumference of the hub middle portion 40*c* which defines in part the target joint 38 extends radially and is complementary in shape to the end of the target shaft third portion 18*c*, with the bolts 36 securely joining the target shaft third portion 18*c* thereto.

This extended configuration of the target shaft 18 increases the available path for effecting a temperature gradient from the target 16 to the bearing rotor hub 40 at the target joint 38. Heat conduction from the target shaft 16 effectively bypasses the corresponding ends 22*b* and 40*a* of the bearing stator 22 and bearing rotor hub 40 into the middle portion 40*c* of the rotor hub around its circumference. The resulting temperature distribution along the bearing rotor hub 40 is therefore more uniform along its axial length. And the maximum temperature of the journal bearing 20 is correspondingly reduced. In particular, the temperature of the bearing at the bearing rotor distal end 22*b* may be substantially reduced since direct heat conduction from the target shaft 18 is prevented. Furthermore, the maximum temperature of the bolts 36 may also be significantly reduced due to this configuration since the target joint 38 is spaced away from the target 16.

In order to more effectively remove heat from the journal bearing 20, suitable means 44 illustrated in FIGS. 1 and 2 are provided for circulating a suitable fluid coolant 44*a*, such as oil, in a closed loop through the bearing stator 22 to remove the heat conducted through the bearing rotor hub 40 to the lubricant contained in the journal annulus 28, with the heat in turn being conducted into the bearing stator 22. The coolant circulator 44 includes a suitable heat exchanger 44*b* disposed outside the X-ray tube 10 which conventionally removes heat from the coolant 44*a*, with the coolant 44*a* being suitably circulated through the bearing stator 22. The bearing stator 22 is preferably a hollow tube having any suitable conduits or channels therein for allowing the coolant 44*a* to be channeled to the distal end 22*b* and removed for removing heat therefrom.

Figure 3:
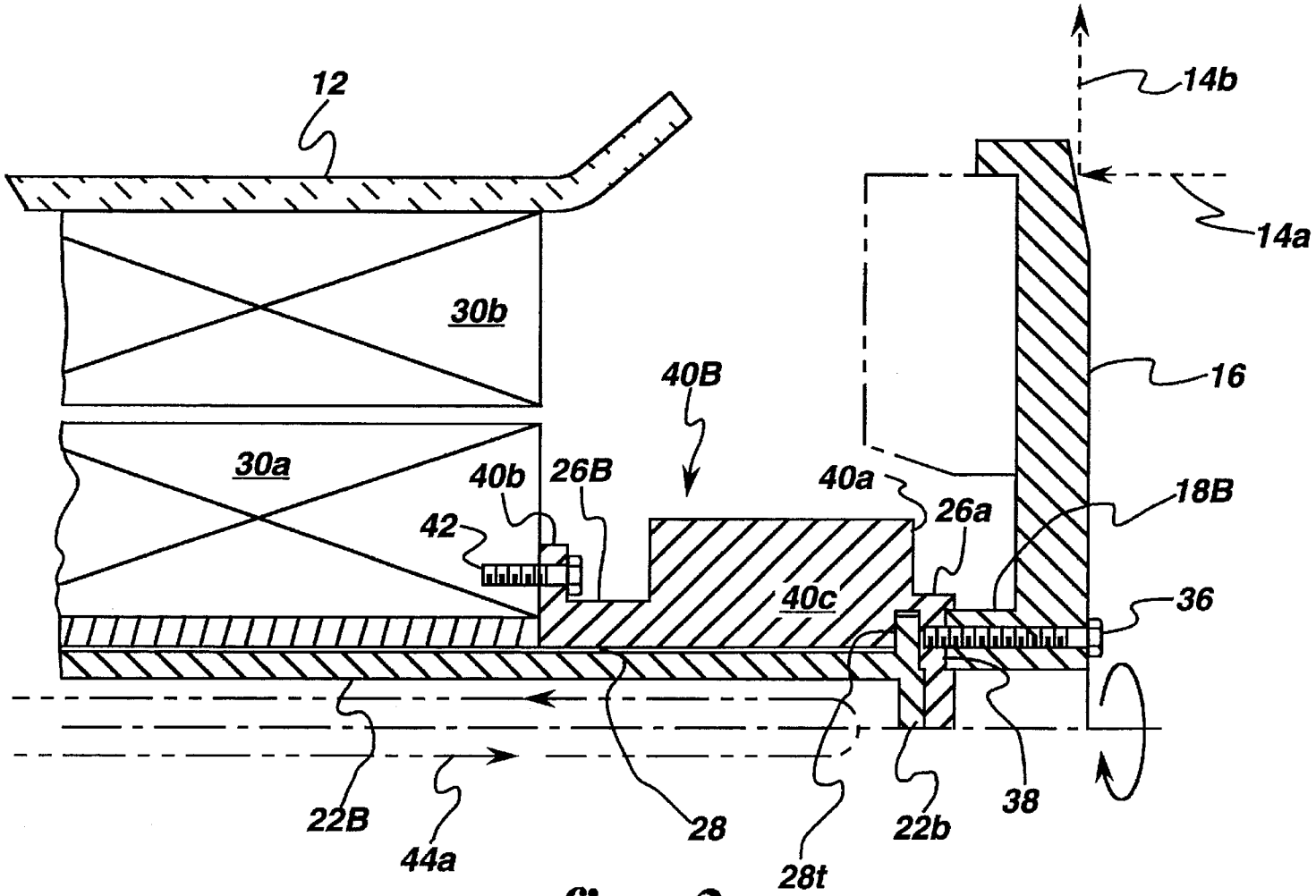
FIG. 3 is a view similar to FIG. 2 illustrating the target, target shaft, and bearing in accordance with another embodiment of the present invention.

Illustrated in FIG. 3 is a portion of the X-ray tube 10 in accordance with a second embodiment of the present invention wherein the bearing stator and rotor are suitably slightly modified, and therefore designated 22B and 26B, so that a shorter and simpler target shaft 18B may be joined directly to the hub front end 40*a*. In this embodiment, the radial land 22*c* of the bearing stator 22B is disposed at the distal end 22*b* thereof. The bearing rotor 26B further includes an annular lip 26*a* which is generally L-shaped in axial section, and is integrally joined to the hub front end 40*a* for capturing the stator land 22*c* to define the thrust bearing 28*t* thereat which is disposed in flow communication with the lubricant in the annulus 28. The lip 26*a* is suitably integrally joined to the rotor hub 40B, by brazing or welding for example, for reducing or eliminating joint heat conduction resistance thereat. The rotor lip 26*a* is preferably joined to the hub front end 40*a* radially between the journal annulus 28, or the outer circumference of the bearing stator 22B, and the circumference of the hub middle portion 40*c*.

The target shaft 18B is a simple cylindrical or tubular member integrally joined to the center of the target 16 in a one-piece component, with the distal or back end of the shaft 18B being joined to the radially inwardly extending portion of the rotor lip 26*a*, in a suitable dado for example, to define the target joint 38 thereat. The target shaft 18B may be removably bolted to the rotor hub 40B by any suitable means. In the exemplary embodiment illustrated in FIG. 3, a plurality of bolts 36 extend axially through the hub of the target 16 and through the annulus of the target shaft 18B to threadingly engage mounting holes in the face of the lip 26*a* to compress the target 16 and the target shaft 18B against the lip 26*a*.

In this way, heat is conducted during operation radially inwardly from the target 16 and axially through the target shaft 18B into the rotor hub 40B firstly axially through the lip 26*a*. Since the lip 26*a* is spaced axially from the bearing stator 22B, direct heat conduction to the stator distal end 22*b* is reduced. Heat conduction is therefore bypassed in part to flow through the base of the lip 26*a* axially into the rotor hub 40B at an elevated radial position through the hub front end 40*a*. In this way, the heat bypassed around the bearing stator distal end 22*b* is preferentially distributed into the lubricant in the journal annulus 28 more uniformly along the axial extent of the rotor hub 40B. The temperature increase at the bearing stator distal end 22*b* is therefore reduced, with heat conduction being more effectively transmitted through the journal annulus 28 and in turn into the bearing stator 22B. The coolant circulating means 44 is also used in this embodiment to circulate the coolant 44*a* inside the hollow bearing stator 22B for removing the heat channeled thereto through the rotor hub 40B.

In this front attachment design illustrated in FIG. 3, the maximum bearing temperature is reduced and the bearing enjoys a more uniform temperature along its axial length. This improves bearing operation and the resulting life thereof. The middle attachment design illustrated in FIG. 2 provides best performance, whereas the front attachment design illustrated in FIG. 3 may be used where desired in the event envelope dimensional limitations are found. The middle attachment design illustrated in FIG. 2 preferably maximizes the radial extent of the bearing rotor hub 40 within available limits such as imposed by any backing plate found on the target 16.

Accordingly, by integrating the target shaft at one end with the target 16, joint heat conduction or resistance therethrough is effectively eliminated as compared to conventional jointed designs. And, by suitably configuring both the target shaft and the bearing rotor hub as disclosed above, heat conduction from the target 16 may be preferentially carried to the bearing rotor to more uniformly distribute the heat and correspondingly reduce temperature at temperature limiting hot regions thereof. Improved heat conduction management is effected, while still retaining the single target joint 38 for providing suitable joint heat resistance for limiting heat transfer into the fasteners which allow assembly and disassembly of the target 16 from the bearing rotor.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims:

I claim:

1. An X-ray tube comprising:

an annular housing having a proximal end, a distal end, and a window disposed therebetween;

an annular anode target having a target shaft disposed integrally therewith and extending axially therefrom for conducting heat away from said target and through said shaft without joint heat resistance;

a bearing rotatably supporting said target to said housing, and including:

a bearing stator extending inside said housing, and having a proximal end fixedly joined thereto, and an opposite distal end;

a bearing rotor surrounding said bearing stator and defining therebetween a journal annulus for receiving a liquid lubricant for rotatably supporting said rotor on said stator, and said rotor including an annular hub disposed at said stator distal end; and said target shaft is removably joined to said bearing rotor hub radially above said journal annulus to conduct heat from said target to said bearing rotor hub initially axially followed in turn by radially inwardly into said lubricant;

means for rotating said target shaft; and means for emitting an electron beam inside said housing adjacent to said distal end for impinging said target to effect X-rays discharged from said tube through said window.

2. A tube according to claim 1 wherein said target shaft is removably joined to said bearing rotor hub at an abutting target joint.

3. A tube according to claim 2 wherein said target shaft is hollow to limit heat conduction into said distal end of said bearing stator.

4. A tube according to claim 3 wherein said rotor hub comprises:

a front end facing said target;

an opposite back end fixedly joined to said rotating means; and a middle portion extending axially therebetween; and said target shaft is joined to one of said hub front end and said middle portion for first conducting heat axially into said middle portion prior to conducting said heat radially inwardly toward said journal annulus.

5. A tube according to claim 4 wherein said target shaft is joined to said hub front end.

6. A tube according to claim 5 wherein:

said bearing stator includes an annular radial land at said distal end thereof;

said bearing rotor further includes an annular lip integrally joined to said hub front end and capturing said stator land to define a thrust bearing thereat disposed in flow communication with said journal annulus; and said target shaft is joined to said rotor lip to conduct heat from said target into said bearing rotor hub at said hub front end.

7. A tube according to claim 6 wherein said rotor lip is joined to said hub front end radially between said journal annulus and a circumference of said hub middle portion.

8. An X-ray tube comprising:

an annular housing having a proximal end, a distal end, and a window disposed therebetween;

an annular anode target having a target shaft disposed integrally therewith and extending axially therefrom for conducting heat away from said target and through said shaft without joint heat resistance;

a bearing rotatably supporting said target to said housing, and including:

a bearing stator extending inside said housing, and having a proximal end fixedly joined thereto, and an opposite distal end;

a bearing rotor surrounding said bearing stator and defining therebetween a journal annulus for receiving a liquid lubricant for rotatably supporting said rotor on said stator, and said rotor including an annular hub disposed at said stator distal end, said rotor hub including:

a front end facing said target and spaced axially from said target;

an opposite back end fixedly joined to said rotating means; and a middle portion extending axially therebetween and having a circumference;

said target shaft being removably joined to said circumference of said hub middle portion at an abutting target joint axially between said hub front and back ends for first conducting heat axially into said hub middle portion prior to conducting said heat radially inwardly toward said journal annulus;

means for rotating said target shaft; and means for emitting an electron beam inside said housing adjacent to said distal end for impinging said target to effect x-rays discharged from said tube through said window.

9. A tube according to claim 8 wherein said target shaft comprises:

a tubular first portion extending from said target;

a second portion extending radially outwardly from an end of said first portion, and spaced axially from said hub front end; and a tubular third portion extending axially from a circumference of said second portion parallel with said first portion 18*a*, with said third portion being spaced radially outwardly in part from said hub middle portion.

10. A tube according to claim 9 wherein said hub middle portion includes a flange, and said target shaft third portion is fixedly joined thereto to effect said target joint thereat.

11. A tube according to claim 10 further comprising means for circulating a coolant inside said bearing stator to remove heat conducted through said bearing rotor hub to said lubricant, and in turn into said bearing stator.

* * * * *